US005180946A

United States Patent [19]

Aiga et al.

[11] Patent Number: 5,180,946

[45] Date of Patent: Jan. 19, 1993

[54] MAGNETRON HAVING COAXIAL CHOKE MEANS EXTENDING INTO THE OUTPUT SIDE INSULATING TUBE SPACE

[75] Inventors: Masayuki Aiga, Kanzaki; Yoshitaka Shibata, Kasai, both of Japan

[73] Assignee: Sanyo Electric Co., Ltd., Osaka, Japan

[21] Appl. No.: 653,429

[22] Filed: Feb. 8, 1991

[30] Foreign Application Priority Data

Feb. 15, 1990 [JP] Japan ..... 2-35217
Apr. 25, 1990 [JP] Japan ..... 2-109098

[51] Int. Cl.[5] ..... H01J 23/54; H01J 25/50
[52] U.S. Cl. ..... 315/39.51; 315/39.53
[58] Field of Search ..... 315/39.51, 39.53, 39.75

[56] References Cited

U.S. PATENT DOCUMENTS

| | | | |
|---|---|---|---|
| 3,849,737 | 11/1974 | Oguro | 315/39.53 X |
| 4,129,834 | 12/1978 | Kerstens | 315/39.53 X |
| 4,289,992 | 9/1981 | Kapitonova | 315/39.75 X |
| 4,371,848 | 2/1983 | Gotjé et al. | 315/39.53 X |
| 4,459,563 | 7/1984 | Kawaguchi | 315/39.53 X |
| 4,494,034 | 1/1985 | Keller | 315/39.51 X |
| 4,833,367 | 5/1989 | Harada | 315/39.53 |

FOREIGN PATENT DOCUMENTS

| | | | |
|---|---|---|---|
| 54-6862 | 4/1979 | Japan . | |
| 58-910 | 1/1983 | Japan . | |
| 61-288347 | 12/1986 | Japan . | |
| 296643 | 12/1986 | Japan | 315/39.51 |
| 2-230640 | 9/1990 | Japan | 315/39.51 |

*Primary Examiner*—Paul M. Dzierzynski
*Assistant Examiner*—Benny T. Lee
*Attorney, Agent, or Firm*—Darby & Darby

[57] ABSTRACT

A magnetron includes an anode cylinder (1), a plurality of vanes (2) attached to the inside of the cylinder, a cylindrical metallic container (15), an output-side insulating tube (16), an antenna conductor (11), and a choke body (21). A hollow cylindrical metallic container (15) forms an airtight space at one end of the anode cylinder (1) and one end of a hollow output-side insulating tube (16) is airtightly connected to the container (15). An antenna conductor (11) electrically coupled with one of the vanes (2) extends through the cylindrical metallic container (15) and the output-side insulating tube (16). One end of a choke body (21) of a length of ¼ wavelength of a harmonic to be suppressed is electrically coupled with the cylindrical metallic container (15), and its other end. The choke body is an annular groove type (21) or of a coaxial type (31).

6 Claims, 9 Drawing Sheets

MAGNETRON HAVING COAXIAL CHOKE MEANS EXTENDING INTO THE OUTPUT SIDE INSULATING TUBE SPACE

BACKGROUND OF THE INVENTION

1. Field of the Invention

The present invention relates to a magnetron utilized for a microwave oven and the like, and more particularly to a magnetron having improved choke means for harmonic suppression.

2. Description of the Background Art

FIG. 1 is a view schematically showing the structure of a microwave oven utilizing a magnetron. Referring to FIG. 1, a microwave oven 1000 has a magnetron 100, a driving power supply 200 for driving the magnetron 100, and a waveguide 300. The microwave oven 1000 is entirely covered with a microwave oven cover 400. Microwaves produced by the magnetron 100 are guided into a space 500 in the microwave oven through the waveguide 300. Microwaves so guided heat and cook food 700 placed on a plate 600.

FIG. 2A is a partially sectional front view showing the structure of a conventional magnetron. FIG. 2B is a partial sectional view taken along line IIB—IIB in FIG. 2A. FIG. 2C is a partially sectional view taken along line IIC—IIC in FIG. 2B. Referring to FIGS. 2A-2C, a typical structure of a conventional magnetron will be described.

Referring to FIGS. 2A-2C, a cathode 3 is disposed in the center of a magnetron 100. The cathode 3 has a filament 5 (see FIG. 2C) and emits electrons. A plurality of plate-shaped vanes 2 of oxygen-free copper or the like are disposed radially to encircle the cathode 3. The vanes 2 have the base ends fixed to the inner wall of an anode cylinder 1 formed of oxygen-free copper or the like, or formed integrally with the anode cylinder 1.

Two inner strap rings 9 selected to be identical in diameter are provided at the upper and lower ends of the vanes (in FIGS. 2A and 2C). The inner strap rings 9 are disposed at a prescribed distance from the tip ends of the vanes 2 with respect to the entire length of the vanes 2. Two outer strap rings 10 selected to be identical to each other in diameter and larger in diameter than the inner strap rings 9 are provided at the upper and lower ends of the vanes 2. The inner strap rings 9 and the outer strap rings 10 are fixed to the vanes 2 to short-circuit every other vane 2. In other words, the upper inner strap ring 9 and the lower outer strap ring 10 are fixed to the same alternately disposed vanes 2, and the upper outer strap ring 10 and the lower inner strap rings 9 are fixed to the remaining vanes 2, respectively.

Two adjacent vanes 2 and the inner wall of the anode cylinder 1 surround spaces 14 (see FIG. 2B) partially opened toward the cathode 3 thereby forming cavity resonators. The oscillation frequency of the magnetron 100 is determined depending upon the resonant frequency of the cavity resonators. In the center of the anode cylinder 1, a cylindrical space is axially defined by the tip ends of the vanes 2. The cathode 3 is arranged in the space. As seen in FIG. 2B, a space 4 is formed between the cathode 3 and the vanes 2 at a prescribed distance is called an interaction space. A uniform direct-current magnetic field is applied to the interaction space in parallel with the central axis of the cathode 3. For this purpose, permanent magnets 12 (see FIG. 2A) are arranged in the vicinity of the upper and lower ends of the anode cylinder 1, respectively. A direct-current or low-frequency high voltage is applied between the cathode 3 and the vanes 2.

As seen in FIG. 2C, the cathode 3 is formed by the filament 5 fabricated helically from tungsten containing thorium and the like, a top hat 7 supporting the upper end of the filament 5 and having a flange 6 which is larger in outer diameter than the filament 5 at the top, and an end hat 8 supporting the lower end of the filament 5. The top hat 7 and the end hat 8 are formed of refractory metal such as molybdenum. The top hat 7 and the end hat 8 prevent electrons from deviating axially from the filament 5.

Alternate ones of the vanes 2 are electrically connected with each other, since the inner strap rings 9 and the outer strap rings 10 are alternately fixed to the upper and lower ends of the vanes 2 as described above. An antenna conductor 11 (see FIGS. 2A, 2F) has one end connected to one of the vanes 2.

In the above mentioned structure, high frequency fields formed in the cavity resonators concentrate on the tip ends of the respective vanes 2 and leak in part into the interaction space 4. The adjacent vanes 2 have potentials reverse to each other at high frequency, since the inner and outer strap rings 9 and 10 couple alternate ones of the vanes 2. An electron group emitted from the cathode 3 spins about the cathode 3 in the interaction space 4 causing interaction between the electron group and the high frequency electric fields, and microwaves are produced as a result. The assembly is completed by an output side insulating tube 16, an exhaust pipe or tubulation 17 and an antenna cap 18.

The microwaves are guided outwardly through the antenna conductor 11 connected to one of the vanes 2. The energy of the electron group is partially consumed as heat, since the conversion efficiency into microwave power is not 100%. Therefore, fins 13 (see FIG. 2A) are provided for heat radiation along the outer circumference of the anode cylinder 1. FIG. 2B shows only the internal structure of the anode cylinder 1, and fins 13 etc. are not shown in the figure.

International standards are established by ITU (International Telecommunication Union) for a magnetron as mentioned above, and a basic frequency of 2,450 MHz is allocated to food heating apparatuses, medical instruments, some industrial instruments and the like. A magnetron used for the above mentioned apparatus and instruments ideally oscillates only microwaves at a fundamental frequency of 2,450 MHz (±50 MHz), but in practice also generates various higher harmonics.

Among the microwave frequencies actually oscillated from a magnetron include various higher harmonics such as the second harmonic, the third harmonic and the like, and components other than the above range are also included in basic waves. When such a harmonic is propagated into the cavity of a microwave oven for example, the shorter the wavelength of the harmonic becomes, the harder will be the shielding thereof, resulting in the more outward leakage. Even a very weak leaky-wave of this kind can cause radio interference. Among such higher harmonics, the fifth harmonic having a frequency of 12.25 GHz (±0.25 GHz) overlaps the working frequency range of satellite broadcasting which has been tested since around 1981 and recently put into practice. Though radiowave frequency allocation for SHF satellite broadcasting varies from nation to nation, the frequency band is set to be in a range of 11.7 to 12.5 GHz.

A technique has been conventionally known, which suppresses the radiation of radio waves having undesirable bandwidths by providing a ¼ wavelength choke at the output of a magnetron itself. Such techniques are disclosed in Japanese Patent Publication No. 54-6862 (1979), Japanese Patent Laying-Open No. 61-288347 (1986), U.S. Pat. No. 4,833,367, etc. A magnetron provided with a choke has a structure as schematically shown in FIG. 3 which is a partially sectional view showing the upper end of an antenna conductor in the magnetron shown in FIG. 2A.

Referring to FIG. 3, a metallic container 15 and an output-side insulating tube 16 surround an antenna conductor 11 and define an airtight space inside the conductor. An exhaust pipe 17 and an antenna cap 18 are secured onto the output-side insulating tube. A choke body 19 is provided to surround the antenna conductor 11 in the metallic container 15. The length d of the groove of the annular groove-type choke body 19 is set to be approximately ¼ wavelength of a harmonic, whose unwanted bandwidth emission is to be suppressed. Unwanted bandwidth emission corresponding to a prescribed harmonic can be thus suppressed by the choke body 19. Also by changing the length d of the groove appropriately, an arbitrary higher harmonic can be suppressed.

Although the conventional technique of suppressing unwanted bandwidth emission, as shown in FIG. 3, is effective in suppressing a harmonic of a relatively long wavelength such as the second harmonic and the third harmonic etc., sufficient effect cannot be obtained in suppressing a harmonic of a short wavelength such as the fifth harmonic of a microwave oven magnetron, which approximately coincides with the frequency band of 12 GHz for SHF satellite broadcasting. This is because the length l of the output-side insulating tube 16 shown in FIG. 3 should be about 10 mm in general due to the high-frequency insulating characteristic, and it is assumed that the inner space of the output-side insulating tube 16 is merely a space through which a harmonic of a short wavelength is radiated outwardly.

Furthermore, another problem related to the conventional technique is that, as shown in FIG. 4, a convex portion 152 can be formed by brazing material having flowed out in a brazed part 151 between the metallic container 15 and the output-side insulating tube 16. Electric field concentration due to a large microwave voltage can be caused between the convex portion 152 and the antenna conductor 11. The electric field concentration permits discharging between the convex portion 152 and the antenna conductor 11 thereby causing cracks in the output-side insulating tube 16 or gas to be released by locally heating the output-side insulating tube 16.

For solving the above mentioned problem, a structure is suggested in Japanese Utility Model Publication No. 58-910 (1983), in which an end to be brazed to the output-side insulating tube of a metallic container protrudes inwardly further than the inner diameter of the output-side insulating tube and is bent toward the output-side. However, the structure only eases the above mentioned electric field concentration and fails to suppress a harmonic having a short wavelength such as the fifth harmonic.

SUMMARY OF THE INVENTION

An object of the present invention is to provide a magnetron which is sufficiently effective in suppressing a harmonic of a short wavelength and includes a choke body having a simple structure.

The magnetron in accordance with the present invention includes a cylindrical anode, a plurality of vanes, a cylindrical metallic container, an output-side insulating tube, an antenna conductor, and choke means for suppressing higher harmonics. The plurality of vanes are provided on the cylindrical anode. The cylindrical metallic container is provided to form an airtight space at one end of the cylindrical anode. The output-side insulating tube has one end coupled in an airtight manner to the cylindrical metallic container. The antenna conductor is electrically coupled to the vanes and extends through the inner spaces of the cylindrical metallic container and the output-side insulating tube. The choke means for suppressing higher harmonics has one end electrically coupled to the cylindrical metallic container and the other end provided to be inside the inner space of the output-side insulating tube.

According to a preferred embodiment of the present invention, the choke means includes a cylindrical metallic body provided so as to surround the antenna conductor. The choke means comprises a coaxial choke including an external conductor of the cylindrical metallic body extending along the upper end of the output-side insulating tube, and a central conductor formed the antenna conductor surrounded by the external conductor.

Alternatively, the choke means includes an annular groove in which one end of the cylindrical metallic body is bent toward the other end thereof so as to form an annular groove space in the inner circumferential plane of the cylindrical metallic body. The length of the cylindrical metallic body in the coaxial choke or the length of the annular groove part may be preferably longer than the distance between the other end of the output-side insulating tube and the other end of the choke means. In this case, the length of the cylindrical metallic body or the length of the annular groove equals approximately a quarter of the wavelength of a harmonic to be suppressed by the choke means.

According to the present invention, the choke means for suppressing higher harmonics is provided in the inner space of the output-side insulating tube, which has been conventionally assumed as a space merely for radiating a harmonic of a short wavelength. The length of the output-side insulating tube, which was assumed as a mere space for radiating a harmonic of a short wavelength, can be reduced with the presence of the choke means for suppressing higher harmonics accordingly. The leakage of a harmonic having a short wavelength from the inner space of the output-side insulating tube can be thus suppressed thereby increasing the effect of suppressing undesired bandwidth radiation by a magnetron itself, i.e. a choke effect.

Also in accordance with the present invention, one end of the choke means for suppressing higher harmonics is electrically coupled to the cylindrical metallic container and the other end is provided to be inside the output-side insulating tube. The junction between the cylindrical metallic container and the output-side insulating tube is therefore covered with the choke means. No discharging takes place between the junction and the antenna conductor as a result. Consequently, electrical field concentration between the junction and the antenna conductor can be reduced.

As described above, the present invention can provide a choke means which is effective in suppressing a harmonic of a short wavelength. The effect suppressing leaky-waves from a magnetron itself can be increased remarkably thereby suppressing interference with SHF satellite broadcasting.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 5:
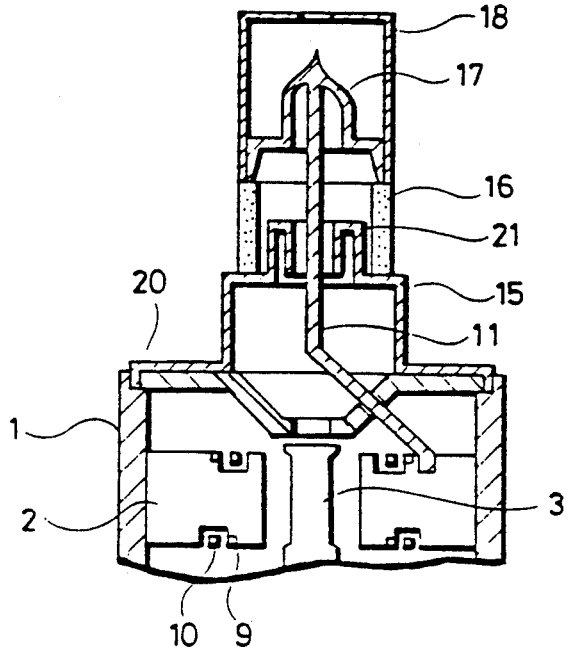
FIG. 5 is a partially sectional view schematically showing a magnetron in accordance with one embodiment of the present invention.

Referring to FIG. 5, a cathode 3 is provided at the center axis of the anode cylinder 1. The vanes 2 are secured to the inner wall of the anode cylinder 1. A plurality of vanes 2 are radially arranged around the cathode 3. A pole piece 20 is secured to one open end of the anode cylinder 1. On the top of the anode cylinder 1, a cylindrical metallic container 15 and an output-side insulating tube 16 are successively assembled and secured, and an airtight space communicating into the anode cylinder 1 is formed. An exhaust pipe tubulation 17 is secured onto the output-side insulating tube 16. One end of an antenna conductor 11 is secured to one of the vanes 2. The antenna conductor 11 extends into the airtight space. The other end of the antenna conductor 11 is secured to the exhaust pipe 17 and thereby supported. The exhaust pipe 17 is covered with an antenna cap 18.

Choke means for suppressing higher harmonics is added to the magnetron having the above described configuration. The choke body 21 is electrically coupled to the end to be connected airtightly to the output-side insulating tube 16 of the metallic container 15. The choke body 21 extends toward the inner space of the output-side insulating tube 16. The choke body 21 has an annular groove in the inner space of the output-side insulating tube 16. The depth of the annular groove is approximately $\frac{1}{4}$ of the wavelength ( 20 of an arbitrary harmonic. Such a $\frac{1}{4}$ wavelength choke body is generally formed based on principles identical to those of door seals etc. used for preventing leaking waves from a microwave oven, and the choke body 21 acts as in a cavity resonator.

Figure 6:
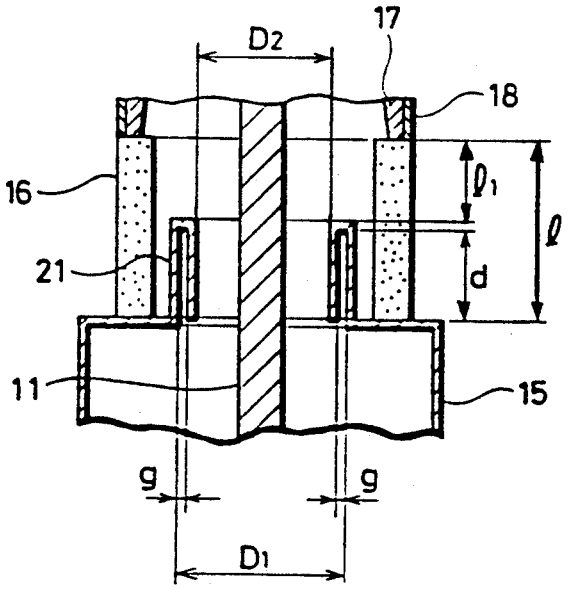
FIG. 6 is an enlarged partially sectional view showing one part of the choke body in accordance with the embodiment shown in FIG. 5.

The choke body 21 is formed integrally with the metallic container 15 by deep drawing utilizing press machinery. In order to suppress the fifth harmonic in a magnetron for a microwave oven having a basic frequency of 2,450 MHz, the depth d of the annular groove of the choke body 21 shown in FIG. 6 is set to be 6.0 mm, i.e. about $\frac{1}{4}$ of the wavelength 24.5 mm of the fifth harmonic. Also in an embodiment of the annular groove choke body shown in FIG. 6, each size of the choke body is set to be; D1=11.0 mm; g=1.0 mm; D2=8.0 mm. It is to be noted that a sufficient distance is kept between the choke body 21 and the antenna conductor 11 so that no discharging takes place due to high-frequency electric fields caused therebetween.

Figure 1:
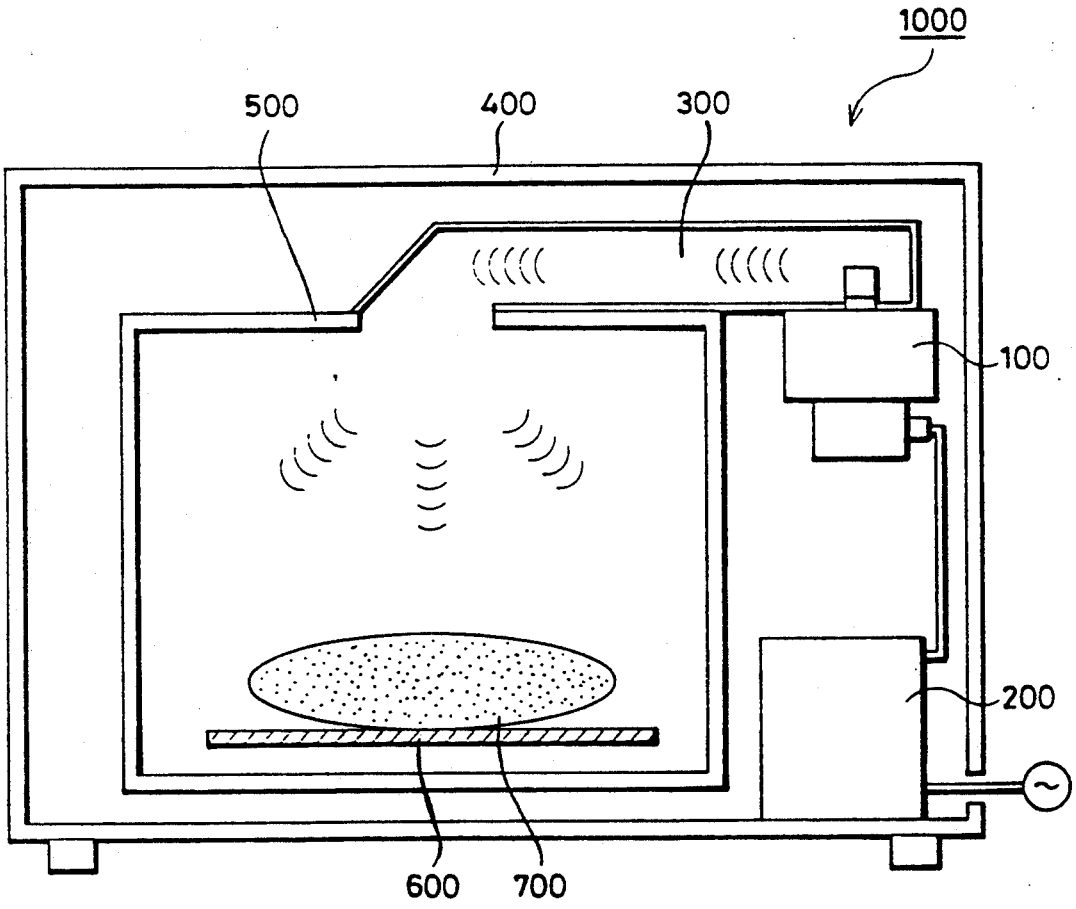
FIG.1 PRIOR ART
FIG. 1 is a view schematically showing the structure of a conventional microwave oven, as an exemplary apparatus to which a magnetron is applied.
Figure 2A:
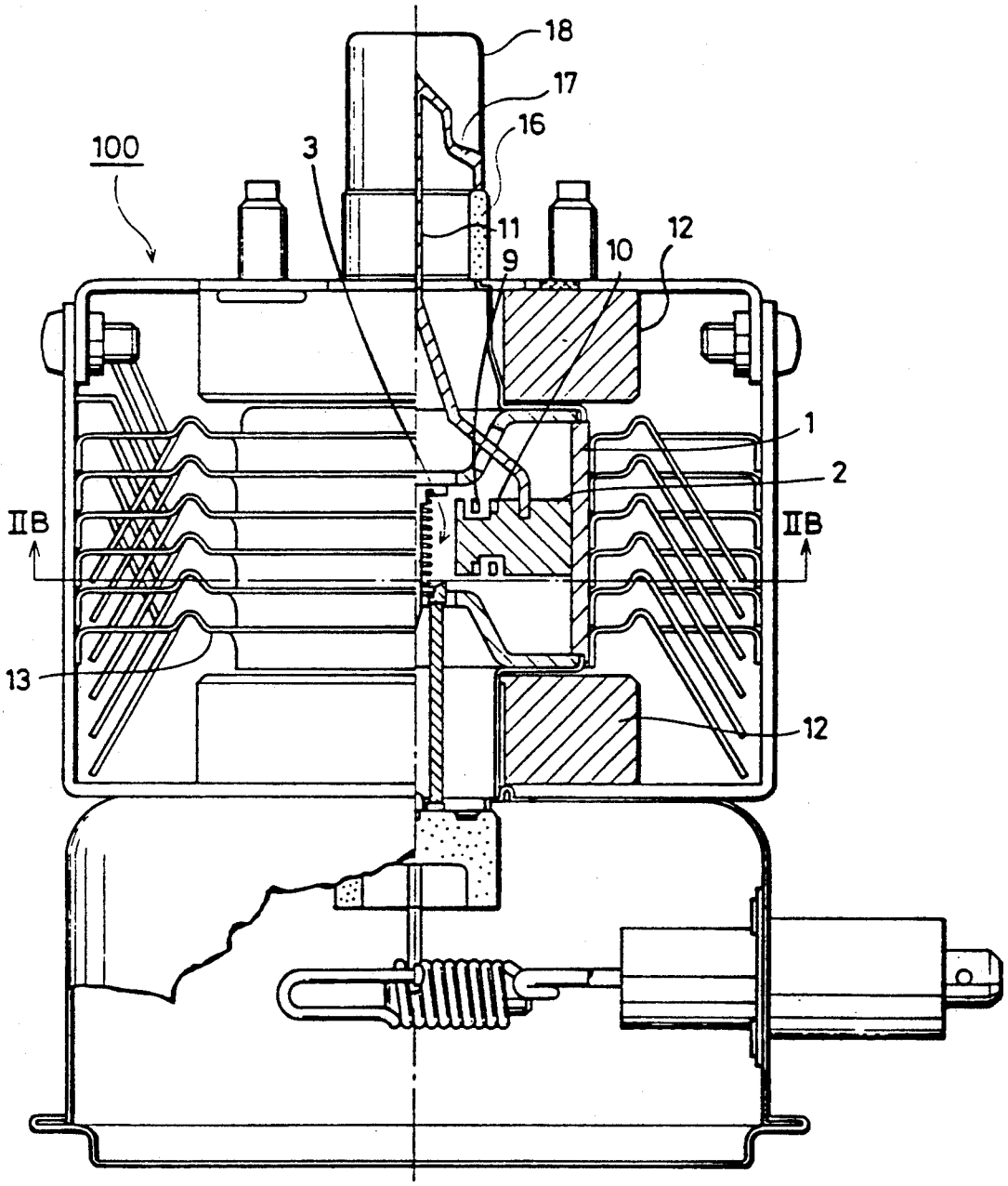
FIG. 2A PRIOR ART
FIG. 2A is a partially fragmented front view showing the structure of a conventional magnetron.
Figure 2B:
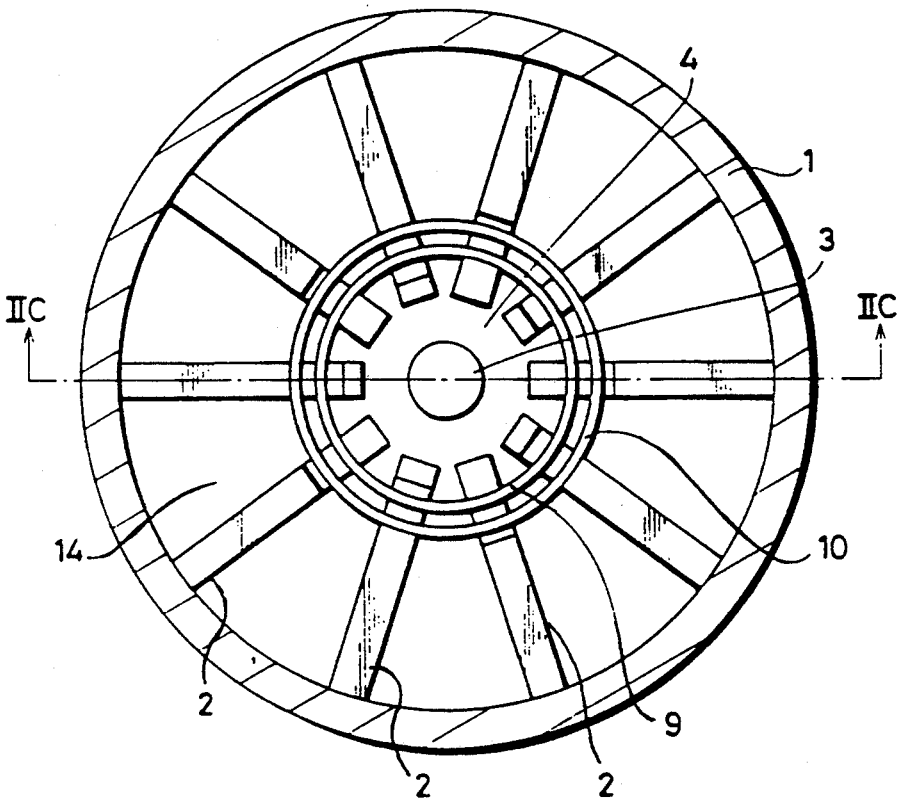
FIG. 2B PRIOR ART
FIG. 2B is a partially sectional view taken along line IIB—IIB in FIG. 2A.
Figure 2C:
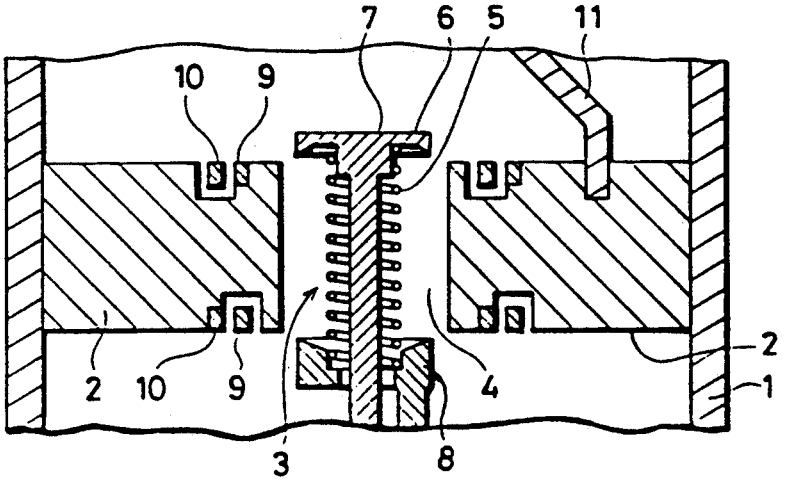
FIG. 2C PRIOR ART
FIG. 2C is a partially sectional view taken along line IIC—IIC in FIG. 2B.
Figure 3:
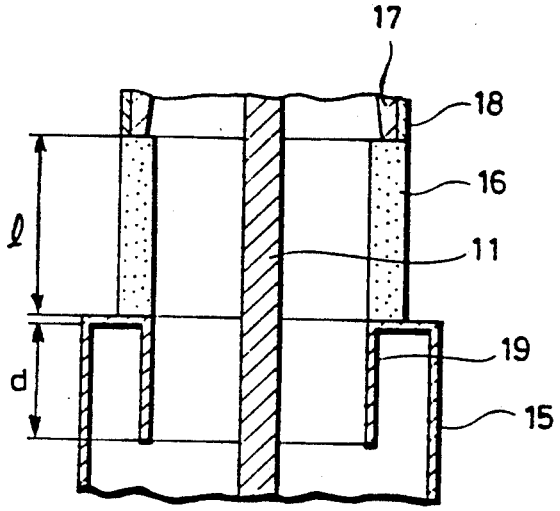
FIG. 3 PRIOR ART
FIG. 3 is an enlarged partially sectional view showing the upper part of the antenna conductor in FIG. 2A and showing a part of a conventional choke body.
Figure 7:
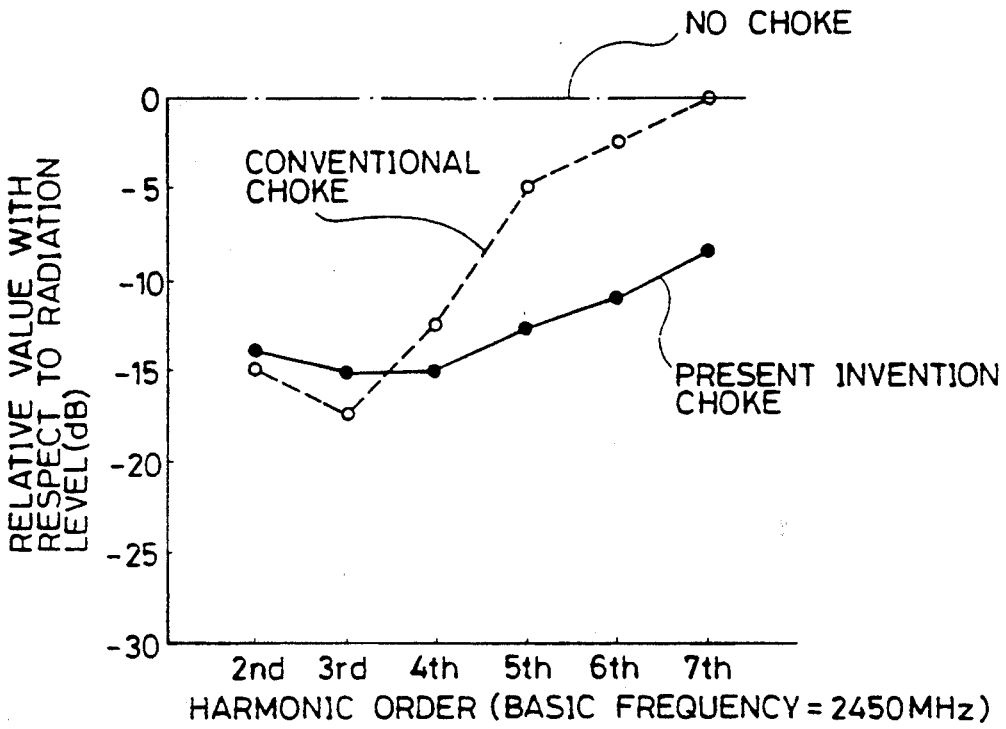
FIG. 7 is a graph of harmonic noise characteristics comparing a conventional choke body and the choke body in accordance with the present invention having the harmonic suppressing effect.

A comparison is made of the effect of suppressing higher harmonics between the choke body of the present invention shown in FIG. 6 and the conventional choke body shown in FIG. 3. FIG. 7 is a graph showing the relative value (in dB) obtained with respect to the radiation level of each harmonic of the conventional choke body and the choke body of the present invention. In the comparison, for each of the conventional choke body and the choke body of the present invention, the length l of the output-side insulating tube 16 is 10 mm, and the size d of the choke body is approximately $\frac{1}{4}$ of the wavelength of a harmonic to be suppressed. As is clear from FIG. 7, the relative value for the radiation level of higher order harmonics of short-wave length such as the fifth, the sixth and the seventh harmonics is reduced, in the case where the choke body of the present invention is used compared to that in use of the conventional choke body. In other words, the use of the choke body of the present invention reduces the length of the inner space of the output-side insulating tube 16 to l1 , the space having been treated as a mere space in terms of higher harmonics, since the inner part corresponding to more than ½ of the length l of the output-side insulating tube 16 is covered with the choke body 21 constructed of metal, as shown in FIG. 6. The space for higher-order harmonics of short wavelength to be radiated is thus reduced, and the choke body of the present invention provides a superior effect in suppressing higher order harmonics of short wavelength compared to the conventional choke body.

Figure 8:
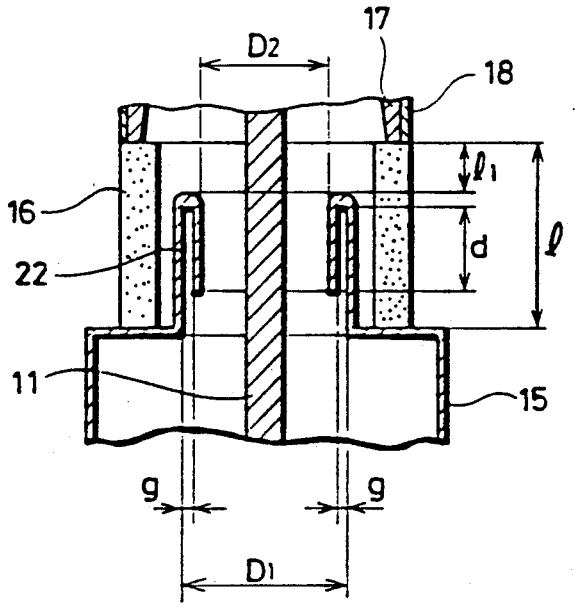
FIG. 8 is an enlarged partially sectional view showing one part of the choke body of another embodiment of a choke body in the magnetron in accordance with the present invention.

In the embodiment of choke body shown in FIG. 6, if the length l of the output-side insulating tube 16 is constant, the shorter the wavelength of a harmonic to be suppressed, the shorter will be the depth d of the annular groove of the choke body 21 thereby increasing the length of the space l1. In the above case, because the length l1 of the radiation space for higher harmonics is increased rather than reduced, the effect of suppressing the leakage of higher harmonics from the output-side insulating tube 16 cannot be obtained as expected. As a solution to the problem, a choke body 22 of an annular groove type is provided in the inner space of the output-side insulating tube 16 in such a fashion that the length of the size l1 is kept short as shown in FIG. 8. One end of the choke body 22 is placed in the upper part of the inner space of the output-side insulating tube 16 compared to the choke body 21 shown in FIG. 6. The choke body 22 having an annular groove of a depth d corresponding to the short wavelength of a higher-order harmonic is provided in such a fashion that the length l1 of the inner space of the output-side insulating tube 16, which is assumed to be a space for harmonic radiation, is kept short.

Figure 9:
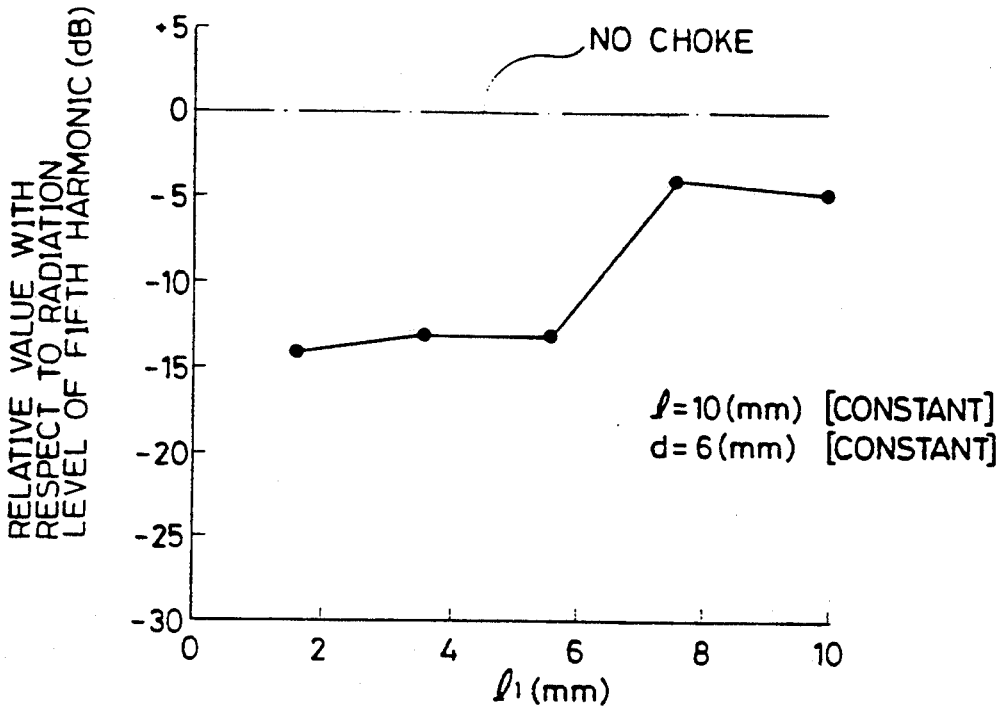
FIG. 9 is a graph showing the characteristic of the fifth harmonic noise in case the size of l1 is changed in the embodiments of the choke body shown in FIG. 6 or FIG. 8.
Figure 10A:
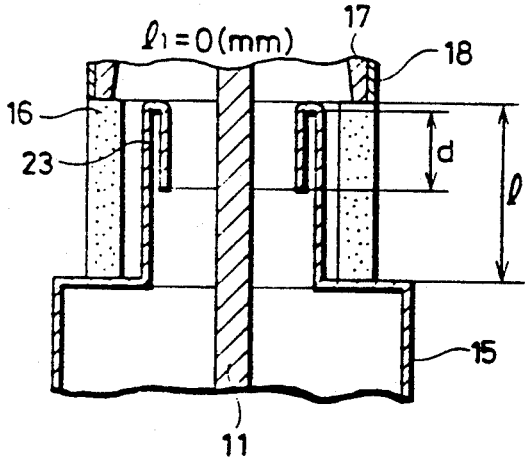
FIGS. 10A and 10B are sectional views showing the respective parts of a choke body corresponding to the upper and lower limits of the size l1.
Figure 10B:
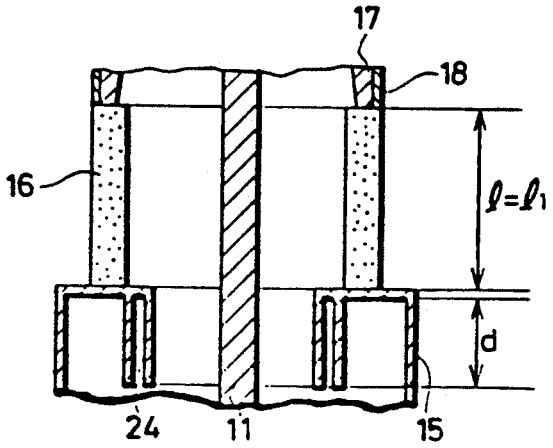

It was observed how the effect of suppressing the fifth harmonic changes by changing the size l1 in the choke body of an annular groove type shown in FIG. 6 or FIG. 8. FIG. 9 is a graph showing the change of the relative value (in dB) obtained with respect to the radiation level of the fifth harmonic, when the length l of the output-side insulating tube 16 is 10 mm; the depth d of the annular groove of the choke body is constant at 6 mm and; only the size l1 is changed, in order to suppress the fifth harmonic. As is apparent from FIG. 9, when the size l1 is beyond the depth d of the annular groove of the choke body, the relative value of the fifth harmonic radiation level drastically increases. In other words, for effective suppression of the fifth harmonic leakage, the depth d of the annular groove of the choke body is preferably equal to the size l1 or longer. The case of the choke body 23 of an annular groove type when l1=0 (mm) in the graph of FIG. 9 corresponds to FIG. 10A, and the case of a choke body 24 of an annular groove type when l1=l=10 (mm) is shown in FIG. 10B.

Figure 11:
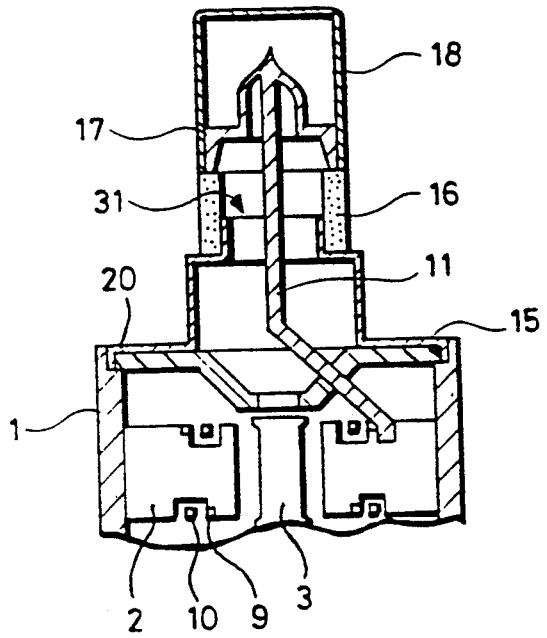
FIG. 11 is a partially sectional view schematically showing another embodiment of the magnetron in accordance with the present invention.

FIG. 11 is a partially sectional view schematically showing a magnetron including a coaxial choke body 31 as another embodiment of the choke body in accordance with the present invention. The magnetron shown in FIG. 11 has the coaxial choke body 31 in place of the annular groove type choke body 21 in the magnetron shown in FIG. 5. The other components of the magnetron in FIG. 11 are identical to those of the magnetron shown in FIG. 5.

Figure 12A:
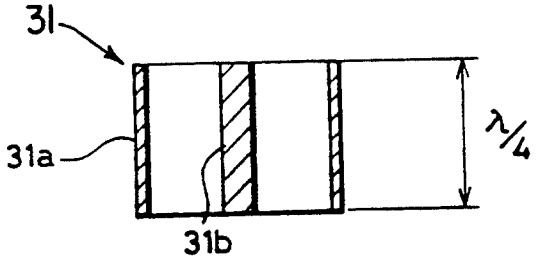
FIG. 12A is a longitudinal sectional view showing a coaxial choke body in accordance with the present invention.
Figure 12B:
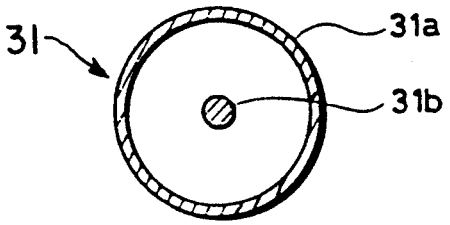
FIG. 12B is a transverse sectional view showing the coaxial choke body in accordance with the present invention.
Figure 12C:
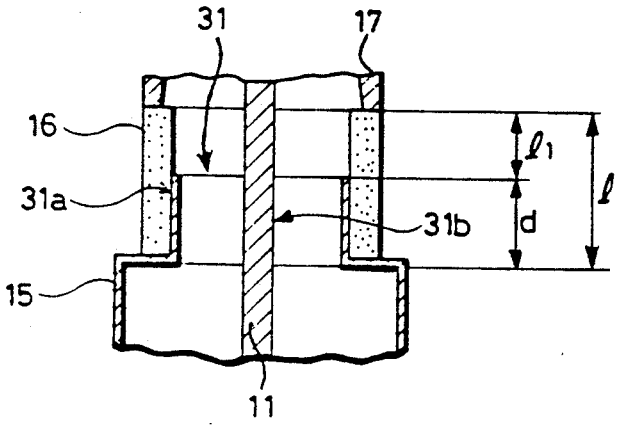
FIG. 12C is a partially sectional view with one part enlarged, showing one embodiment of the coaxial choke body in accordance with the present invention in the magnetron shown in FIG. 11.

Referring to FIG. 12C, in order to add choke means for suppressing higher harmonics, the coaxial type choke body 31 is electrically coupled with one end of the metallic container 15 to be connected airtightly with the output-side insulating tube 16. The coaxial type choke body consists of an external conductor 31*a* and a central conductor 31*b*. The external conductor 31*a* has a length of approximately ¼ of the wavelength of an arbitrary harmonic to be suppressed. The central conductor 31*b* comprises the antenna conductor 11. A longitudinal cross section of such a coaxial type choke body 31 is shown in FIG. 12A, and the transversal cross section is shown in FIG. 12B. The coaxial type choke body is also based on the same principles as those of the above described annular groove type choke body, and is a kind of ¼ wavelength choke body. The length d of the external conductor 31*a* is therefore set to be equal to about a quarter (λ/4) of the wavelength (λ) of a harmonic to be suppressed. A harmonic having the wavelength is therefore hard to be emitted beyond the region of the external conductor 31 and in the direction in which the antenna conductor 11 extends.

The external conductor 31*a* of the coaxial type choke body is formed integrally with the metallic container 15 by deep drawing utilizing press machinery. In order to suppress the leakage of the fifth harmonic in a magnetron for a microwave oven having a basic frequency of 2,450 MHz, the length d of the external conductor 31*a* shown in FIG. 12C is set to be about ¼ of the wavelength 24.5 mm of the fifth harmonic.

As is the case with the above described annular groove type choke body, in the coaxial type choke body in accordance with the present invention, the inner part corresponding to more than half of the length l (=10 mm) of the output-side insulating tube 16 is covered with the external conductor 31*a*, and, therefore, the length of the inner space of the output-side insulating tube 16, which is assumed to be a space simply for radiation in terms of harmonic is reduced to l1. A superior suppressing effect is thus obtained compared to a conventional choke body with respect to high-order harmonics of short wavelength.

Figure 4:
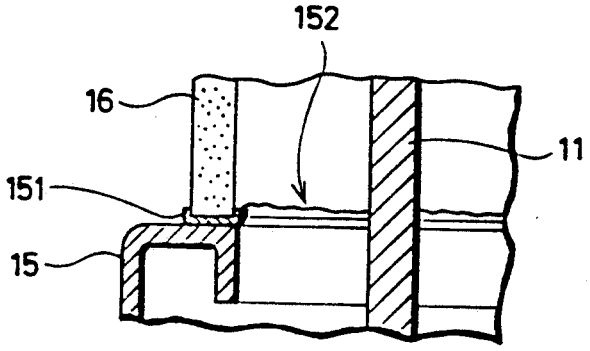
FIG. 4 PRIOR ART
FIG. 4 is an enlarged partially sectional view showing one part of a conventional choke body in order to clarify other problems related to the choke body.

Furthermore, in use of the choke body in accordance with the present invention, the brazed part 151 between the metallic container 15 and the output-side insulating tube 16 shown in FIG. 4 is covered with the external conductor of a coaxial type choke body or an annular groove type choke body. No discharging is therefore caused between the antenna conductor 11 and the brazed part 151 thereby reducing electric field concentration.

Figure 13:
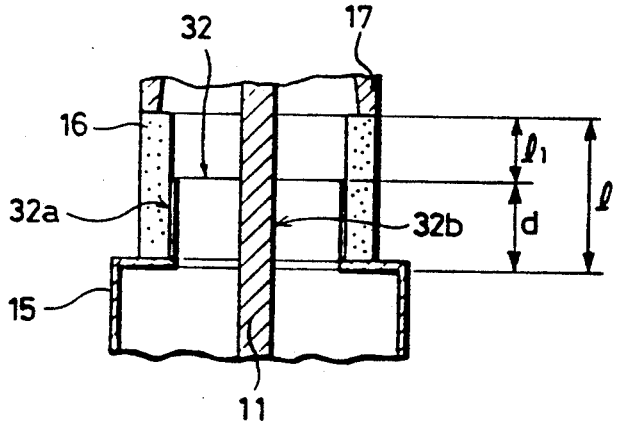
FIG. 13 is a partially sectional view showing another embodiment of the coaxial choke body in accordance with the present invention in the magnetron shown in FIG. 11 being enlarged.

As shown in FIG. 13, the coaxial type choke body 32 may also comprise an external conductor 32*a* of a metallized layer and a central conductor 32*b* formed of an antenna conductor 11. In this case, the external conductor 32*a* is formed as a metallized layer containing metal such as molybdenum, manganese and the like in the inner wall plane of the output-side insulating tube 16.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A magnetron for producing microwave energy at a predetermined fundamental frequency comprising:

an anode of cylindrical shape;

a plurality of vanes attached to said anode;

a cathode disposed inside of and spaced from said anode for emitting electrons;

a cylindrical metallic container for realizing an airtight inner space integral with and extending from one end of said anode;

an output-side insulating tube having one end thereof airtightly connected to said cylindrical metallic container at a point spaced from said anode and having the other end thereof extending outwardly of said container;

an antenna conductor electrically coupled with one of said plurality of vanes and extending through the inner space of said cylindrical metallic container and through said output-side insulating tube; and coaxial choke means for suppressing a higher harmonic of said fundamental frequency comprising a choke portion of a length (d) having one end thereof connected to said cylindrical metallic container and having the other end thereof extending into the output-side insulating tube and said choke means surrounding the antenna conductor; the length (d) of said extending choke portion of said cylindrical metallic body being longer than a distance between said other end of said output-side insulating tube and said other end of said choke portion.

2. The magnetron in accordance with claim 1, wherein the length (d) of said choke portion equals approximately ¼ of the wavelength (λ) of said harmonic to be suppressed by said choke means.

3. A magnetron for producing microwave energy at a predetermined fundamental frequency comprising:

an anode of cylindrical shape with an inner surface;

a plurality of vanes attached to the inner surface of said anode;

a cathode disposed inside of and spaced from said anode for emitting electrons;

a cylindrical metallic container for realizing an airtight inner space integral with and extending from one end said anode;

an output-side insulating tube having one end thereof airtightly connected to said cylindrical metallic container at a point spaced from said anode and having the other end thereof extending outwardly of said container;

an antenna conductor electrically coupled with one of said plurality of vanes and extending through the inner space of said cylindrical metallic container and through said output-side insulating tube; and choke means for suppressing a higher harmonic of said fundamental frequency comprising an annular extension of length (d) of said cylindrical metallic body and having a free end thereof extending within said output-side insulating tube and surrounding said antenna conductor and spaced therefrom, the length (d) of said annular extension being greater than a distance between said other end of said output-side insulating tube and said other end of said annular extension.

4. The magnetron in accordance with claim 3, wherein the length (d) of said annular extension equals approximately ¼ of the wavelength (λ) of said harmonic of the fundamental frequency to be suppressed by said choke means.

5. The magnetron of claim 3 wherein said annular extension comprises a folded member with an outer part and an inner leaf part spaced therefrom.

6. The magnetron of claim 5 wherein the inner leaf of said folded member has a length not greater than the length (d) of said extension.

* * * * *